US009502765B2

(12) United States Patent
Boutayeb et al.

(10) Patent No.: US 9,502,765 B2
(45) Date of Patent: Nov. 22, 2016

(54) APPARATUS AND METHOD OF A DUAL POLARIZED BROADBAND AGILE CYLINDRICAL ANTENNA ARRAY WITH RECONFIGURABLE RADIAL WAVEGUIDES

(71) Applicant: Huawei Technologies Co., Ltd., Shenzhen (CN)

(72) Inventors: Halim Boutayeb, Montreal (CA); Paul Robert Watson, Kanata (CA); Toby Kemp, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 264 days.

(21) Appl. No.: 14/319,981

(22) Filed: Jun. 30, 2014

(65) Prior Publication Data

US 2015/0380814 A1 Dec. 31, 2015

(51) Int. Cl.
*H01Q 21/00* (2006.01)
*H01Q 3/24* (2006.01)
(Continued)

(52) U.S. Cl.
CPC ..... *H01Q 3/24* (2013.01); *H01Q 3/446* (2013.01); *H01Q 15/14* (2013.01); *H01Q 21/0037* (2013.01); *H01Q 21/24* (2013.01)

(58) Field of Classification Search
CPC ..... H01P 1/122; H01P 1/125; H01P 1/182; H01P 1/39; H01Q 21/064; H01Q 21/005; H01Q 21/0043; H01Q 3/24; H01Q 3/242; H01Q 3/247; H01Q 3/26; H01Q 3/2629; H01Q 21/00
USPC ..... 330/295, 297; 333/125, 126, 127, 128, 333/129, 130, 131, 132, 133, 134, 135, 136, 333/137; 343/776
See application file for complete search history.

(56) References Cited

U.S. PATENT DOCUMENTS 2,532,551 A * 12/1950 Jarvis ..... H01Q 13/04 342/187
4,072,951 A 2/1978 Kaloi
(Continued)

FOREIGN PATENT DOCUMENTS

CN 1412890 A 4/2003
CN 102576937 A 7/2012
(Continued)

OTHER PUBLICATIONS

Antenna Array Excited by the Radial Waveguide, Sedek et al.*
(Continued)

*Primary Examiner* — Dameon E Levi
*Assistant Examiner* — Awat Salih
(74) *Attorney, Agent, or Firm* — Slater Matsil, LLP

(57) ABSTRACT

Embodiments are provided for an agile antenna that beam-steers radio frequency (RF) signals by selectively activating/de-activating tunable elements on radial-waveguides using direct current (DC) switches. The antenna comprises two parallel radial waveguide structures, each comprising a first radial plate, a second radial plate in parallel with the first radial plate, and conductive elements positioned vertically and distributed radially between the two plates. The radial waveguide structure further includes a plurality of quarter RF chokes which are connected to the conductive elements via respective micro-strips and tunable elements. The two parallel radial plates are separated by a height determined according to a desired transmission frequency range for RF signals, a length of the micro-strips, a diameter of the conductive elements, and a clearance space around each one of the conductive elements.

21 Claims, 17 Drawing Sheets

(51) Int. Cl.

| | |
|---|---|
| ***H01Q 3/44*** | (2006.01) |
| ***H01Q 15/14*** | (2006.01) |
| ***H01Q 21/24*** | (2006.01) |

(56) References Cited

U.S. PATENT DOCUMENTS

| | | | | |
|---|---|---|---|---|
| 4,605,932 | A * | 8/1986 | Butscher | H01Q 1/286 343/700 MS |
| 4,673,899 | A * | 6/1987 | Jespersen | H01P 5/12 333/137 |
| 4,899,162 | A * | 2/1990 | Bayetto | H01Q 21/205 343/700 MS |
| 5,767,807 | A | 6/1998 | Pritchett | |
| 7,636,070 | B2 | 12/2009 | De Lustrac et al. | |
| 8,339,327 | B2 | 12/2012 | Schadler et al. | |
| 2002/0113743 | A1* | 8/2002 | Judd | H01Q 1/007 343/757 |
| 2003/0076271 | A1 | 4/2003 | Borlez et al. | |
| 2005/0201672 | A1* | 9/2005 | Mansour | H01P 1/125 385/16 |
| 2006/0176124 | A1* | 8/2006 | Mansour | H01P 1/122 333/108 |
| 2008/0316139 | A1 | 12/2008 | Blaser et al. | |
| 2011/0080325 | A1 | 4/2011 | Livneh et al. | |
| 2013/0342424 | A1 | 12/2013 | Park et al. | |
| 2014/0218237 | A1 | 8/2014 | Boutayeb | |

FOREIGN PATENT DOCUMENTS

| | | | |
|---|---|---|---|
| CN | 102832432 | A | 12/2012 |
| CN | 103811849 | A | 5/2014 |
| JP | 2000-196350 | A | 7/2000 |

OTHER PUBLICATIONS

The High-Power Radial Line Helical Circular Array Antenna: Theory and Development, Li et al.*

Broadband Radial Waveguide Spatial Combiner, Song et al.*

Broadband radial waveguide power amplifier using spatial power combining technique, Song et al.*

International Search Report received in Application No. PCT/CN2015/082586, mailed Sep. 2, 2015, 11 pages.

International Search Report received in Application No. PCT/CN2015/082894, mailed Sep. 21, 2015, 10 pages.

* cited by examiner

APPARATUS AND METHOD OF A DUAL POLARIZED BROADBAND AGILE CYLINDRICAL ANTENNA ARRAY WITH RECONFIGURABLE RADIAL WAVEGUIDES

TECHNICAL FIELD

The present invention relates to antenna design, and, in particular embodiments, to an apparatus and method for a dual polarized broadband agile cylindrical antenna array with reconfigurable radial waveguides.

BACKGROUND

Modern wireless transmitters of radio frequency (RF) signals or antennas perform beamsteering to manipulate the direction of a main lobe of a radiation pattern and achieve enhanced spatial selectivity. Conventional beamsteering techniques rely on manipulating the phase of RF signals through a series of phase shifters and RF switches. The inclusion of phase shifters, RF switches, and other complex components increase the manufacturing cost and design complexity of agile antennas. Accordingly, less complex agile antenna designs with broadband transmissions are desired.

SUMMARY OF THE INVENTION

In accordance with an embodiment, a radial waveguide structure in an antenna comprises a first radial plate, a second radial plate substantially in parallel with the first radial plate, and a plurality of conductive elements positioned vertically and distributed radially between the first radial plate and the second radial plate. The conductive elements are connected to micro-strips and tunable elements. The radial waveguide structure further includes a plurality of quarter radio frequency (RF) chokes which are connected to the conductive elements via the micro-strips and the tunable elements. The first radial plate and the second plate are separated by a height determined according to a desired transmission frequency range for RF signals, a length of the micro-strips, a diameter of the conductive elements, and a diameter of a clearance space around each one of the conductive elements.

In accordance with another embodiment, an antenna device includes a first radial waveguide structure comprising two first parallel radial plates and a plurality of first conductive elements connected to tunable elements and positioned vertically between the two first parallel plates. The two first parallel plates are separated by a height determined according to desired transmission frequency range for radio frequency (RF) signals, a diameter of the conductive elements, and a clearance space around each one of the conductive elements. The antenna device further includes a second radial waveguide structure similar to the first waveguide structure and comprising two second parallel radial plates and a plurality of second conductive elements similar to the first active elements and connected to second tunable elements. The second conductive elements have the same clearance space as the first conductive elements and are positioned vertically between the two second parallel plates. The two second plates are separated by a same height of separation of the first two parallel plates. The antenna device also includes a plurality of radiating elements positioned between the first radial waveguide structure and the second radial waveguide structure, and distributed radially around a circumference of the first radial waveguide structure and a circumference of the second radial waveguide structure. The first radial waveguide structure and the second radial waveguide structure are in substantially parallel.

In accordance with yet another embodiment, a method for an antenna with broadband radio transmission includes determining a frequency range desired for the broadband radio transmission of the antenna, determining a height of a plurality of conductive elements of the antenna. The height enables the broadband radio transmission in the frequency range. The method further includes determining, in accordance with the height and the frequency range, a diameter of two parallel plates of the antenna. A radial waveguide structure of the antenna is assembled by positioning vertically and distributing radially the conductive elements between the parallel plates. A second radial waveguide structure similar to the radial waveguide structure is assembled by positioning vertically and distributing radially a plurality of second conductive elements, similar to the conductive elements, between two second parallel plates similar to the two parallel plates. The method further includes positioning the radial waveguide structure and the second radial waveguide structure substantially in parallel, and placing a plurality of radial elements around a circumference of the radial waveguide structure and a circumference of the second radial waveguide structure.

The foregoing has outlined rather broadly the features of an embodiment of the present invention in order that the detailed description of the invention that follows may be better understood. Additional features and advantages of embodiments of the invention will be described hereinafter, which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawing, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Disclosed herein are embodiments for an agile antenna that beamsteers wireless transmissions, e.g., RF or microwave signals, by selectively activating/de-activating tunable elements on radial-waveguides using direct current (DC) switches. The antenna is a dual polarized agile antenna comprising two radial waveguides with electronically controlled power dividers and suitable for broadband transmissions, e.g., in the RF or microwave frequency range. As used herein, the term RF frequencies and RF signals is used to represent frequencies and signals, respectively, in the RF, microwave, and other suitable regions of the spectrum for wireless communications.

Figure 1:
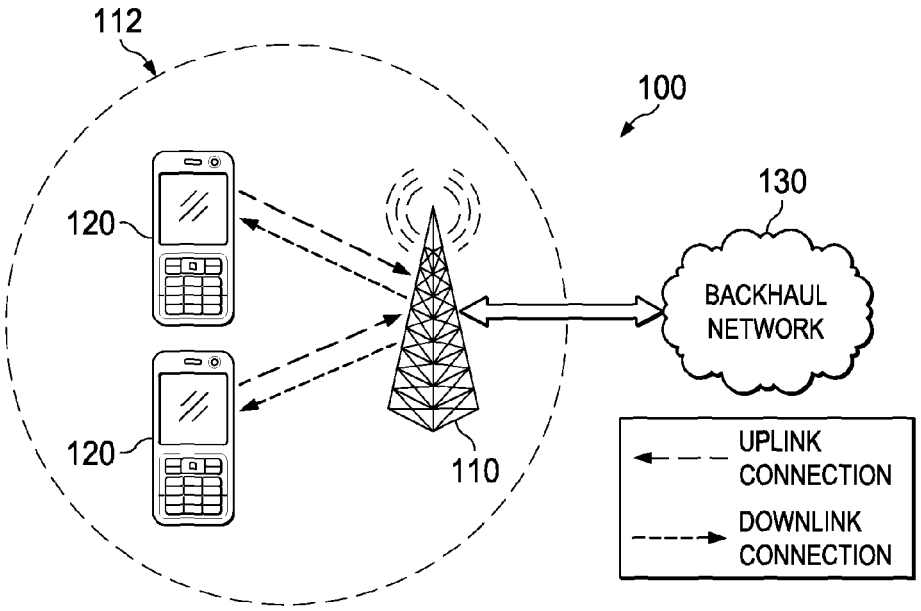
FIG. 1 illustrates a diagram of a wireless network for communicating data.

FIG. 1 illustrates a network 100 for communicating data. The network 100 comprises an access point (AP) 110 having a coverage area 112, a plurality of user equipments (UEs) 120, and a backhaul network 130. The AP 110 may comprise any component capable of providing wireless access, e.g., to establish uplink (dashed line) and/or downlink (dotted line) connections with the UEs 120. Examples of the AP 110 include a base station (nodeB), an enhanced base station (eNB), a femtocell, and other wirelessly enabled devices. The UEs 120 may comprise any components capable of establishing a wireless connection with the AP 110. The backhaul network 130 may be any component or collection of components that allow data to be exchanged between the AP 110 and a remote end (not shown). In some embodiments, the network 100 may comprise various other wireless devices, such as relays, femtocells, etc. The AP 110 or other wireless communication devices of the network 100 may comprise an agile antenna device as described below. The agile antenna is used to transmit/receive the wireless or RF signals with the other devices such as for cellular and/or WiFi communications.

Figure 2:
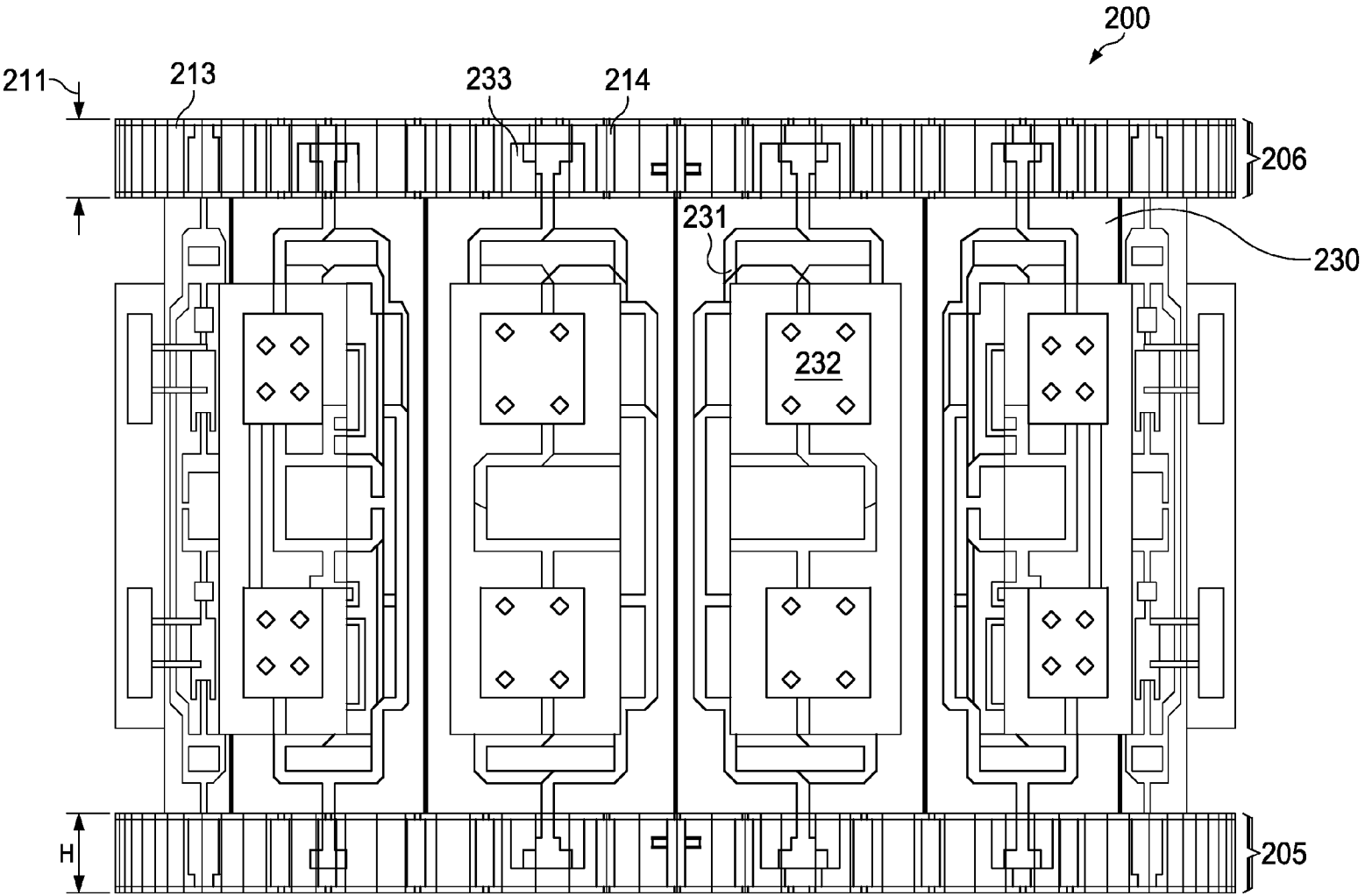
FIG. 2 is a side view of a dual port waveguide antenna according to an embodiment of the disclosure.

FIG. 2 shows an embodiment of a dual polarized agile antenna 200, also referred to herein as a dual port waveguide antenna. The dual port waveguide antenna 200 comprises a first radial waveguide structure 205 (e.g., at the bottom or base of the antenna) and a second radial waveguide structure 206 (e.g., at the top of the antenna), which are similar. Each waveguide structure is composed of two parallel radial surfaces separated from each other by a suitable distance. The parallel radial surfaces/plates 211 are electrically connected via a conductive means 213 forming a short circuit termination, which reduces radiation loss compared to open circuit terminated waveguide. The parallel plates 211 are separated by a predetermined height, H, that promotes broadband operation of the antenna, as described further below. In an embodiment, the conductive means 213 is a conductive gasket placed around the edges of both plates 211, as described further below. A series of radiating elements 230 is distributed between the first radial waveguide structure 205 and the second radial waveguide structure 206 around the circumference of the two radial waveguides. The radiating elements 230 comprise conductive feed paths 231. Further, a patch 232 is coupled to an outer surface of each radiating element 230. The edges (both bottom and top edges) of the radiating elements 230 form edge probes 233 that electrically connect the radiating elements 230 to the first radial waveguide structure 205 and the second radial waveguide structure 206. The edge probes 233 are part of the radiating elements 230 and printed with the radiating elements 230 in the fabrication process, which simplifies the manufacturing process of the radiating elements 230 and the edge probes 233. Each radial waveguide also includes a series of ground pins 214 between the two surfaces/plates 211. The ground pins 214 are distributed around the circumference of the radial waveguide and close to the edge probes 233 of the radiating elements 230. Each ground pin 214 may be placed about equal distances from an adjacent pair of edge probes 233.

Figure 3:
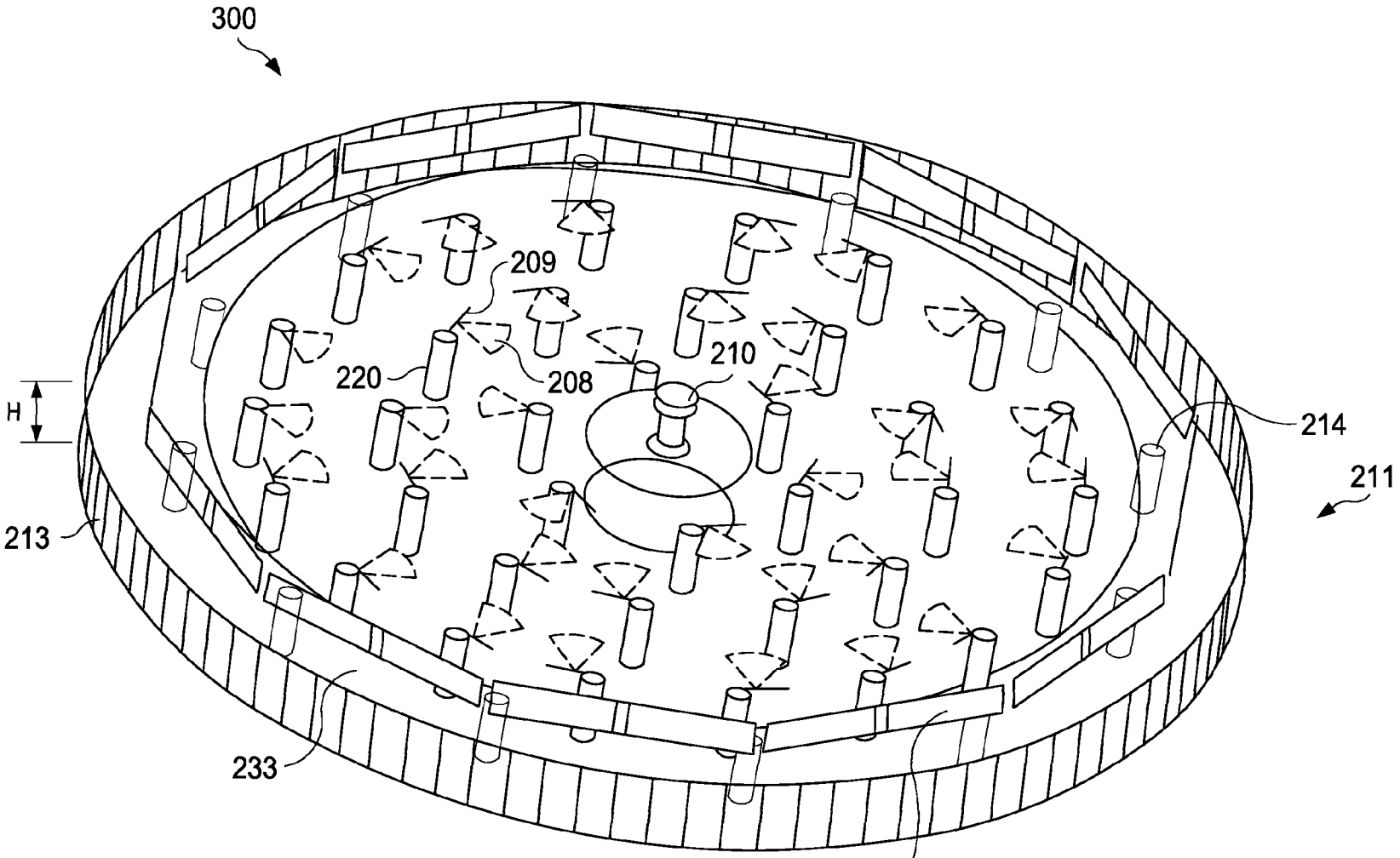
FIG. 3 is an isometric view of a radial waveguide of the dual port waveguide antenna of FIG. 2.

FIG. 3 shows an embodiment of a radial waveguide structure design 300 corresponding to the first radial waveguide structure 205 or the second radial waveguide structure 206. The figure shows the conductive means 213 (e.g., the conductive gasket), portions of the edge probes 233 (at one end of the radiating elements 230), and the ground pins 214. The radial waveguide structure is coupled to a line feed 210 and comprises a plurality of vertical metal or cylindrical conductive elements 220 and RF chokes 208. The line feed 210 is placed on top of an exposed surface of one of the radial plates 211 (shown partially), at the center of the plate 211. The conductive elements 220 are conductive (e.g., metallic) cylinders or wires that are positioned vertically between the radial plates 211, and interspersed horizontally between the line feed 210 and the radiating elements 230, as shown. The RF choke 208 is connected to an end of the conductive elements 220 at the surface/plate 211 connected to the line feed 210. The conductive elements 220 are further coupled to tunable components (as described below) that rely on a source of energy (e.g., DC power) to change the flow of current over the radial waveguide structure 205/206, such as (for example) a PIN diode. In other embodiments, the tunable elements include electromechanical components that change the flow of current using moving parts or electrical connections, such as micro-electromechanical systems (MEMS) components. The RF chokes 208 may include any components configured to block RF frequency signal without blocking the DC signal. The RF chokes 208 are connected to the top of the respective conductive elements 220 by micro-strips 209.

The components above are designed along with the height H between the plates 211 of the radial waveguide structures 205/206 to allow broadband operation of the antenna, as described further below. The line feed 210 is coupled to and positioned at the center of one the plates 211 of the radial waveguide structure 300. As such, the line feed 210 provides an electrical signal (e.g., as a RF signal), which radiates outwardly over the radial waveguide structure 300. The conductive elements 220 are distributed between the radial waveguide surfaces/plates 211, and are interspersed between the line feed 210 and the radiating elements 230 (of which only the edge probes 233 are shown). The conductive elements 220 are connected to tunable elements (as described below) that may be selectively activated/deactivated for the purpose of directing propagation of the RF signal towards selected radiating elements 230. As such, activated tunable elements at the conductive elements 220 act as a power divider that beamsteers wireless transmissions of the antenna. More details regarding the components of the radial waveguide structure 300 are described in U.S. application Ser. No. 13/760,980 filed on Feb. 6, 2013 by Halim Boutayeb and entitled "Electronically Steerable Antenna Using Reconfigurable Power Divider Based on Cylindrical Electromagnetic Band Gap (CEBG) Structure," which is hereby incorporated herein by reference as if reproduced in its entirety.

However, unlike the omni-directional antenna design of the reference application above, the dual port waveguide antenna 200 includes two radial waveguide structures 205 and 206 (or dual polarization ports) that provide increased agility, better power efficiency, and improved interference mitigation. The dual polarization port waveguides are similar, as described above, and can be controlled similarly to achieve matching polarization thereby substantially doubling the radiation power or signal-to-noise ratio and achieving the improvements above. Such antenna can be used for media-based modulation, for example. The dual port waveguide antenna 200 also is capable of providing broadband operation as described further below.

Figure 4:
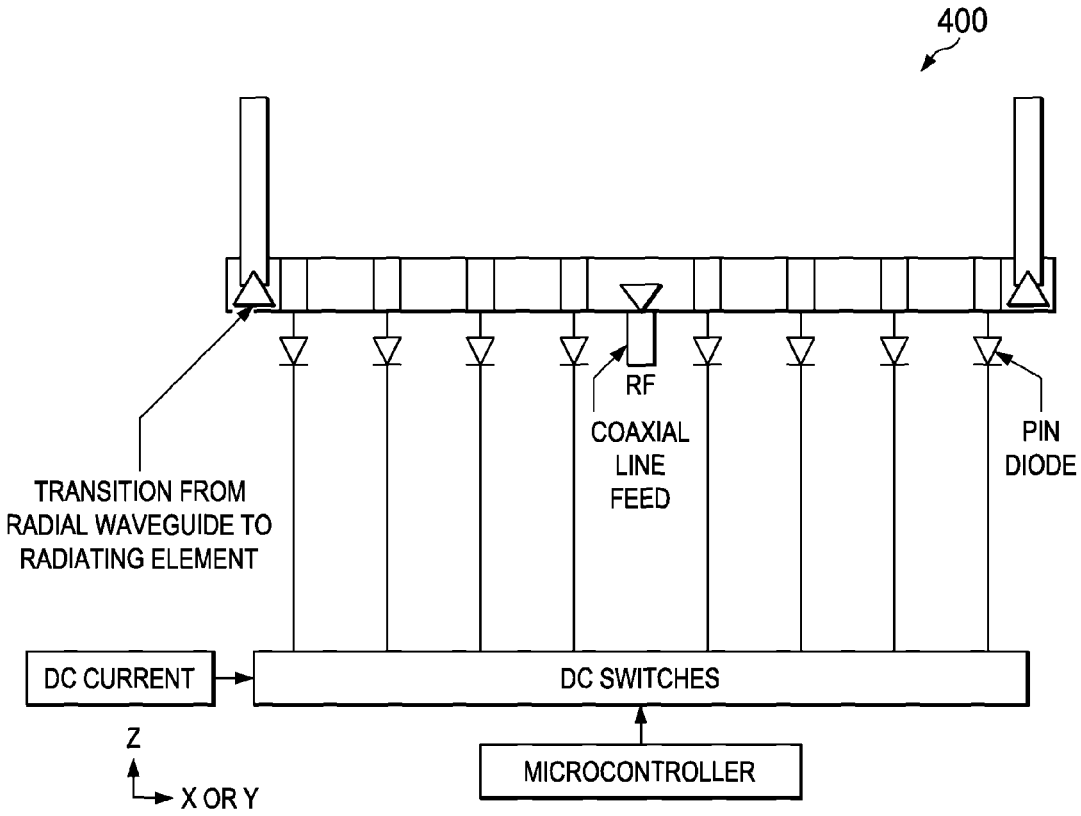
FIG. 4 is a side view of a DC control system for the radial waveguide of the dual port waveguide antenna according to an embodiment of the disclosure.

FIG. 4 shows an embodiment of a DC control system 400 for the radial waveguide of the dual port waveguide antenna. The system 400 utilizes DC switches (driven by DC current) for beamsteering control of the agile antenna. Such control system makes the antenna less complex than conventional agile antennas (which rely on phase shifters and RF switches to effectuate beamsteering). As shown, a group of diodes (PIN diodes) are controlled by a microcontroller via a series of DC switches. The beamsteering related processing in the agile antenna is based on manipulating the group of PIN diodes, and therefore may be far less complex than the baseband processing (e.g., computing phase/amplitude shifts, etc.) inherent to conventional agile antennas. The microcontroller may be of lower complexity and consumes less power than the processors included in conventional agile antenna designs. Also shown is a coaxial line feed at the center of the radial waveguide. The coaxial line feed is connected to a RF signal source (not shown).

Figure 5:
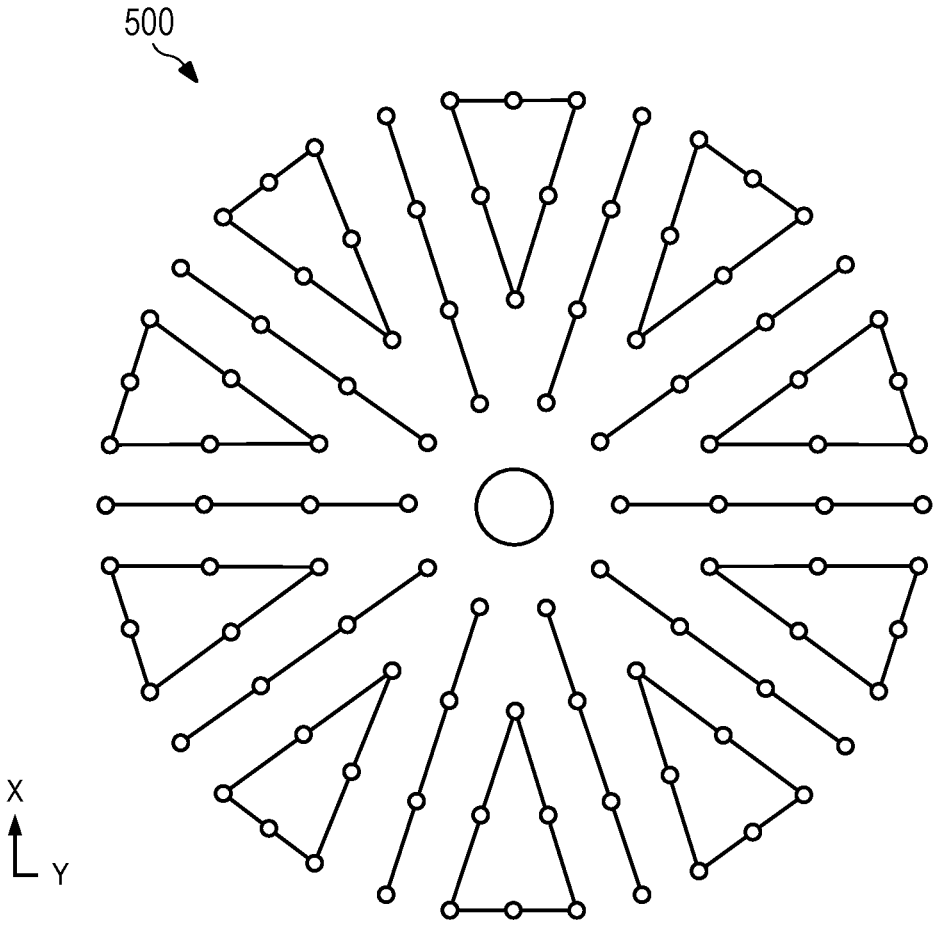
FIG. 5 is a top view of groups of tunable elements in the radial waveguide of the dual port waveguide antenna according to an embodiment of the disclosure.

In some configurations, the number of DC switches required to effectuate beamsteering is reduced by using a common switch to activate groups of active elements. FIG. 5 shows groups of conductive elements 220 with tunable or active elements in the agile antenna 200 that can be controlled by a common switch. The groups of tunable elements at the conductive elements 220 (as indicated by the lines) are controlled by the same switch such that fewer switches (e.g., twenty switches in FIG. 5) are used to control beamsteering.

Figure 6:
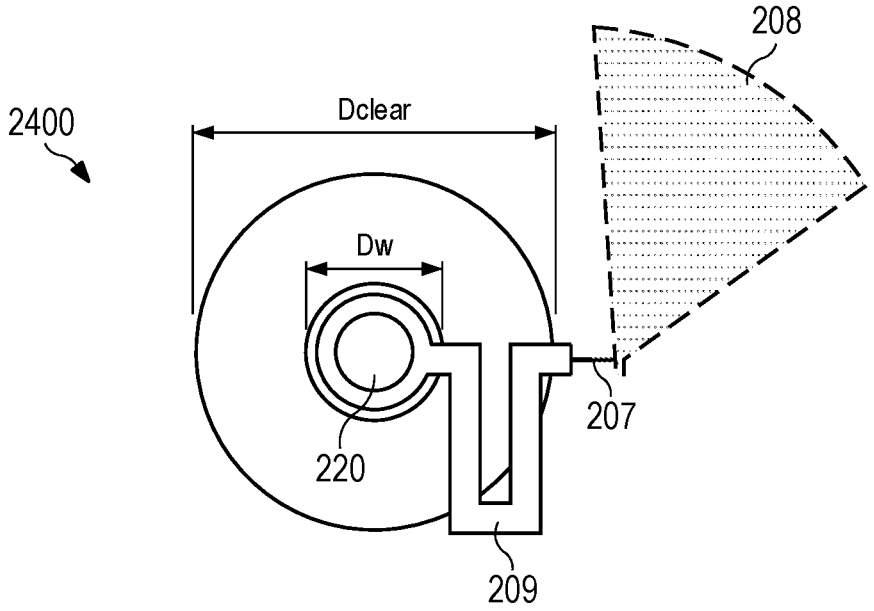
FIG. 6 is a top view of an embodiment design for tunable elements for the antenna.

FIG. 6 is a top view showing an embodiment design 2400 for resonator structure including the conductive element 220 and RF choke 208, which are connected to each other via the micro-strip 209. A tunable or active element such as a PIN diode 207 is also positioned between the micro-strip 209 and the RF choke 208. The combination of these elements forms one DC controlled resonator in the radial structure waveguide 205/206. The micro-strips 209 of the resonators in the radial waveguide structure 205/206 may have different lengths, L, to optimize the transmission coefficient (increase transmissions over a wider range of frequencies). The RF choke 208 is a quarter wavelength open radial stub. The conductive element 220 has a suitable diameter, Dw. For a given height H between the plates 211 of the radial waveguide structure 205/206, the frequency of resonance of each resonator is controlled by the diameter Dw, the length L, and the diameter of the clearance space around the conductive element, Dclear (shown in FIG. 6). To promote a broadband frequency (wideband) operation of the antenna, H is set to about a quarter wavelength. This is possible by the design 2400 of the resonator and by adjusting the dimensions (L, Dw, Dclear, H) of its components accordingly.

Figure 7:
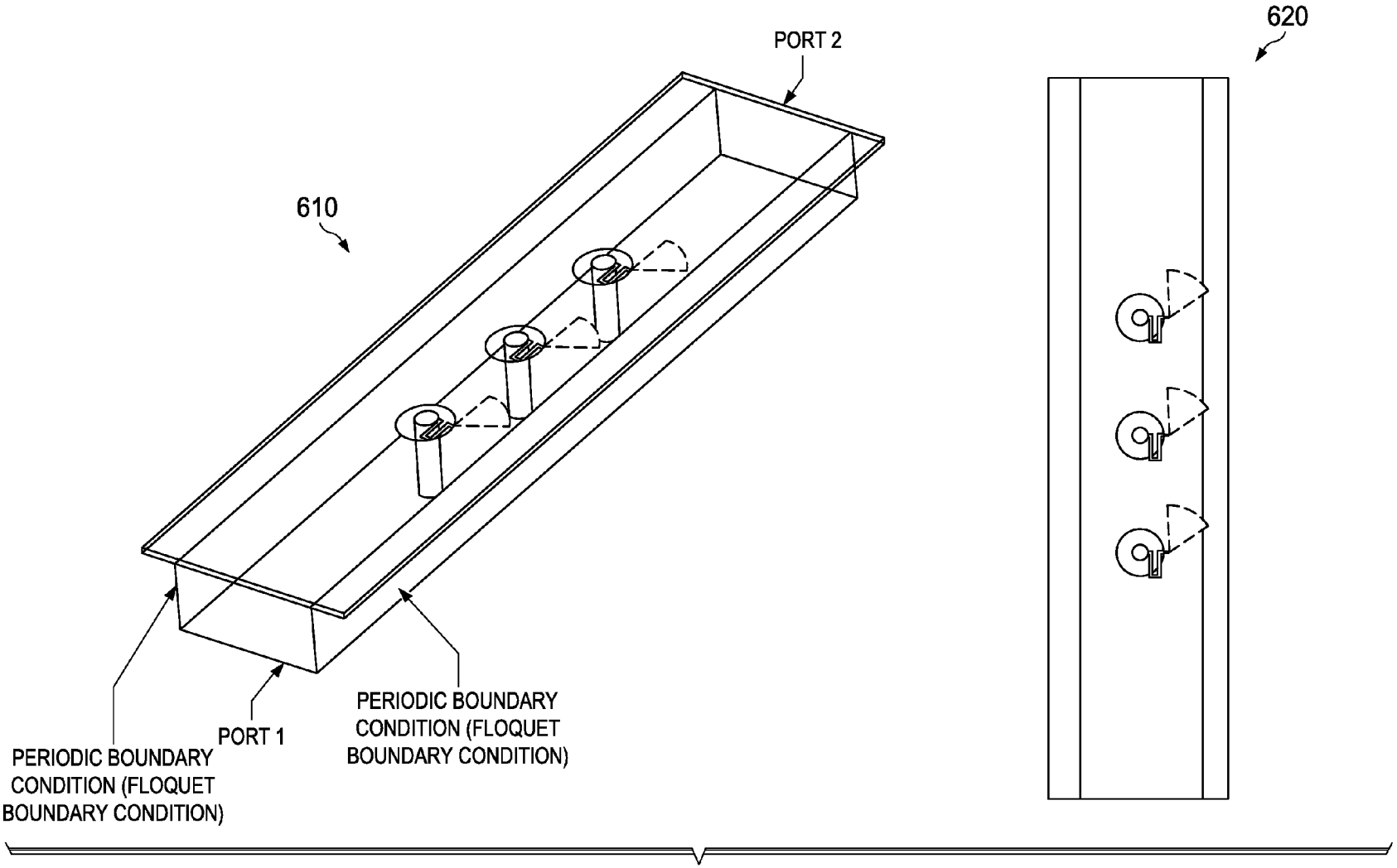
FIG. 7 shows isometric and top views of a test waveguide structure including the tunable elements in FIG. 6.

FIG. 7 shows an isometric view 610 and a top view 620 of a test waveguide structure including a plurality of structures similar to the resonator structure of FIG. 7. The test waveguide structure is simulated (using computer simulation) as a rectangular waveguide including a row of 3 active structures with periodic boundary conditions (Floquet boundary condition). The structure has two ports (Port 1 and Port 2) on opposite ends of the row of elements.

Figure 8:
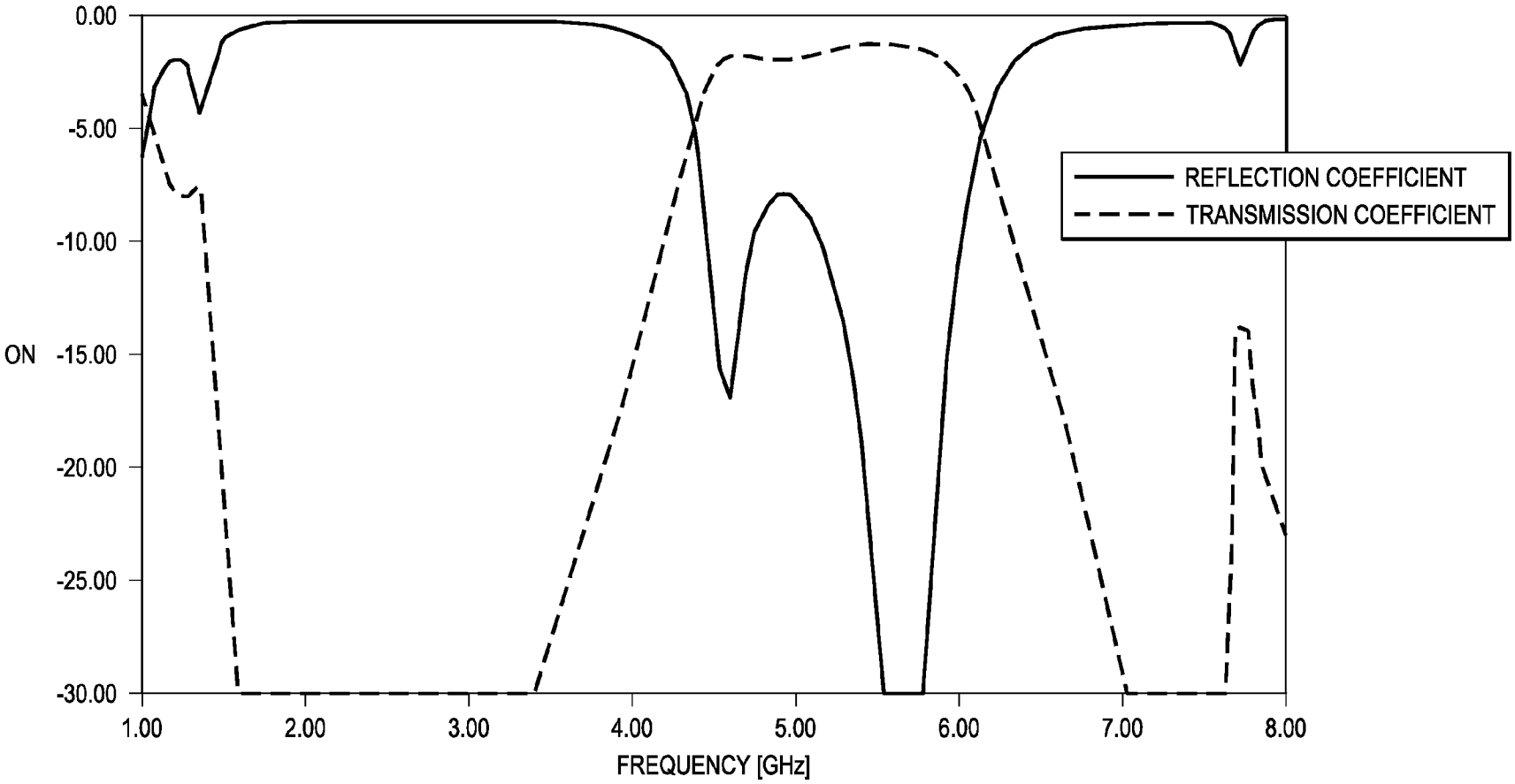
FIG. 8 is a graph of a frequency spectrum for a first design of the test waveguide structure of FIG. 7 in ON state, according to an embodiment of the disclosure.
Figure 9:
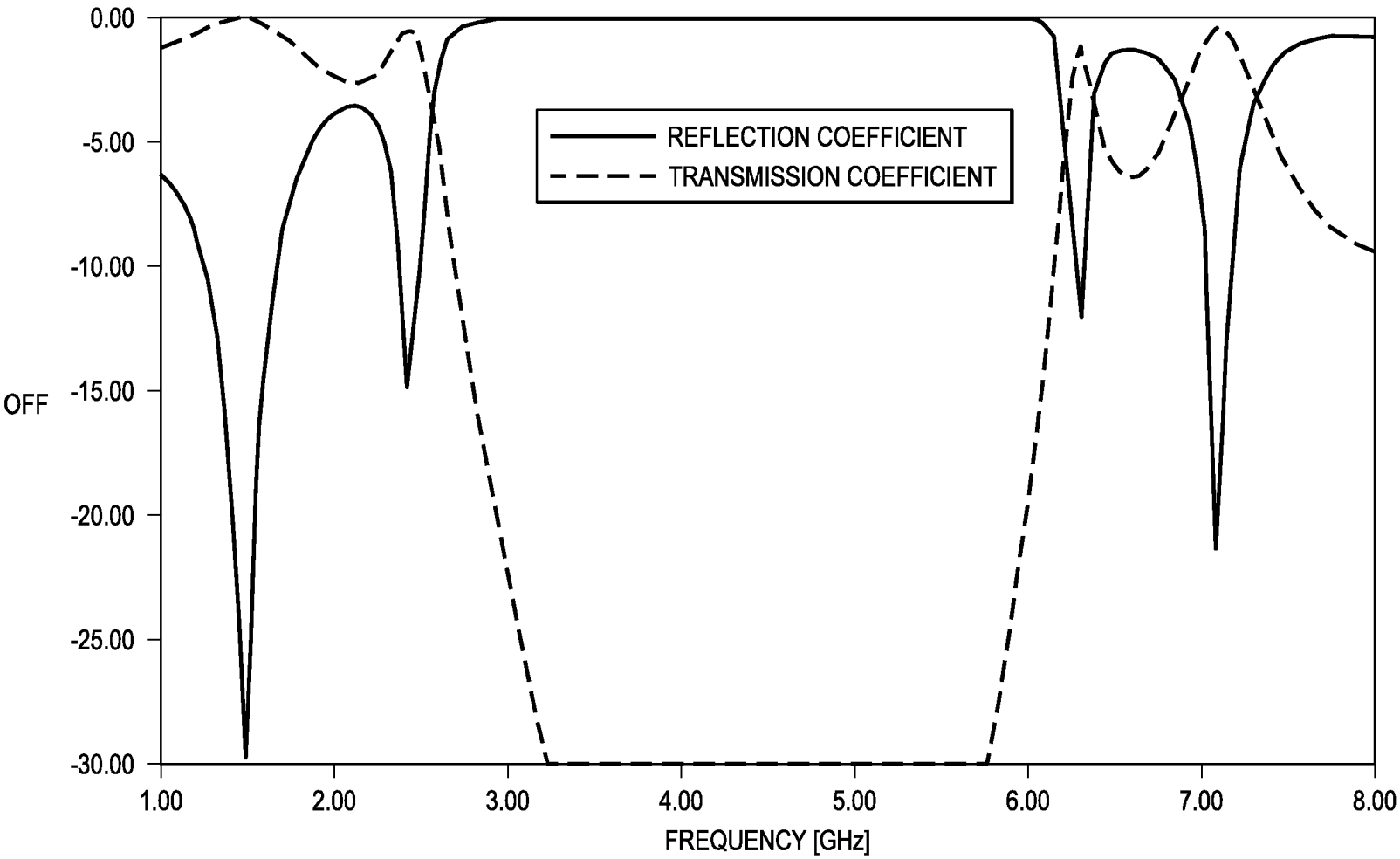
FIG. 9 is a graph of a frequency spectrum for the first design of the test waveguide structure of FIG. 7 in OFF state.

FIG. 8 shows a frequency spectrum, obtained by simulation, for the test waveguide structure in ON state (PIN diodes 207 are switched ON), and FIG. 9 is the frequency spectrum in the OFF state (PIN diodes 207 are switched OFF). The test structure design includes to the following dimensions: H=10 mm, Dw=3.2 mm, L=0.5 mm, and Dclear=8 mm. The values of the transmission coefficient (dashed line curve) and the reflection coefficient (solid line curve) are shown in dB across a frequency range from 1 to 8 Gigahertz (GHz). The curves in FIGS. 8 and 9 show that the resonator structures (including the PIN diodes 207) can be used for passing radiation when the PIN diodes 207 are ON, in the band from 5 to 6 GHz.

Figure 10:
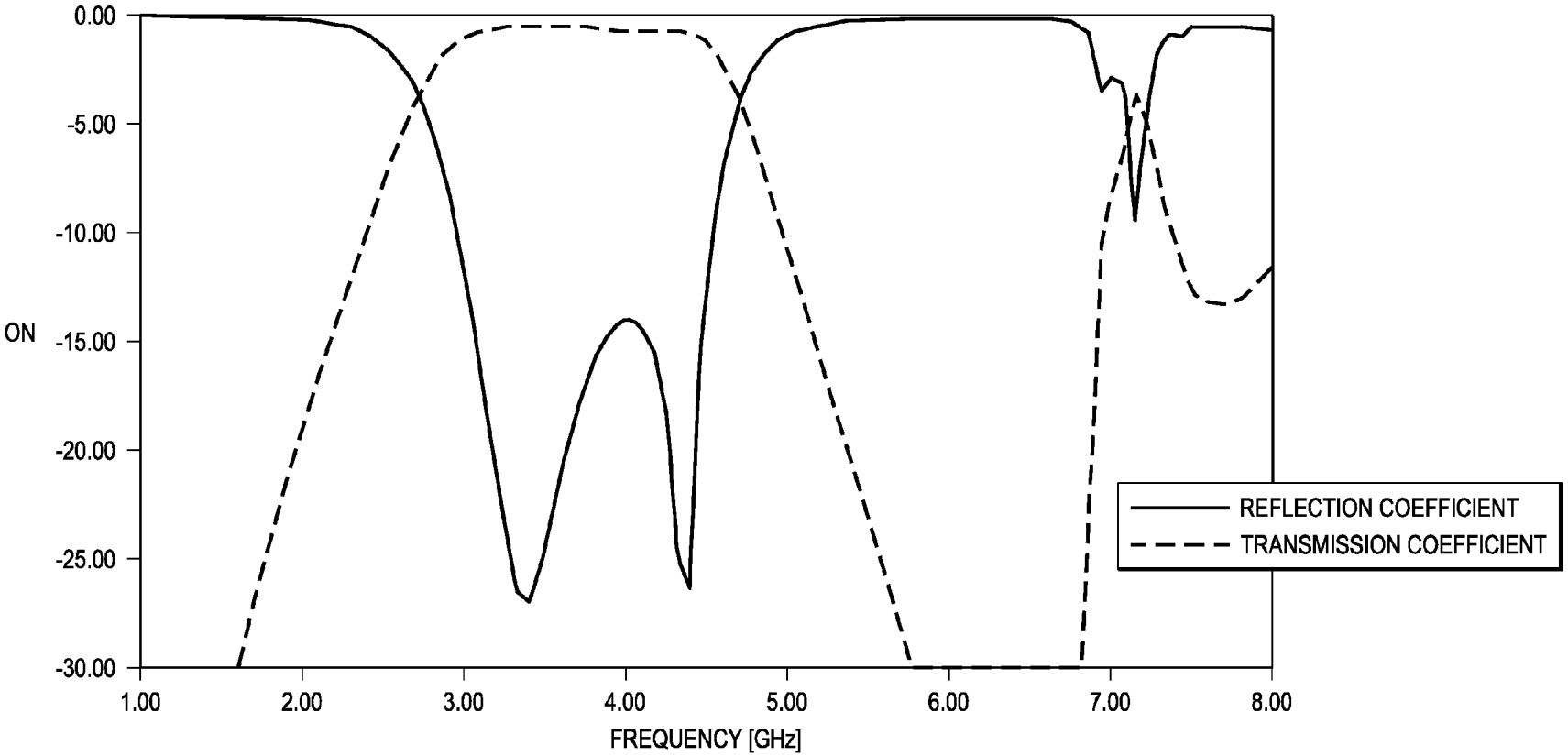
FIG. 10 is a graph of a frequency spectrum for a second design of the test waveguide structure of FIG. 7 in ON state, according to an embodiment of the disclosure.
Figure 11:
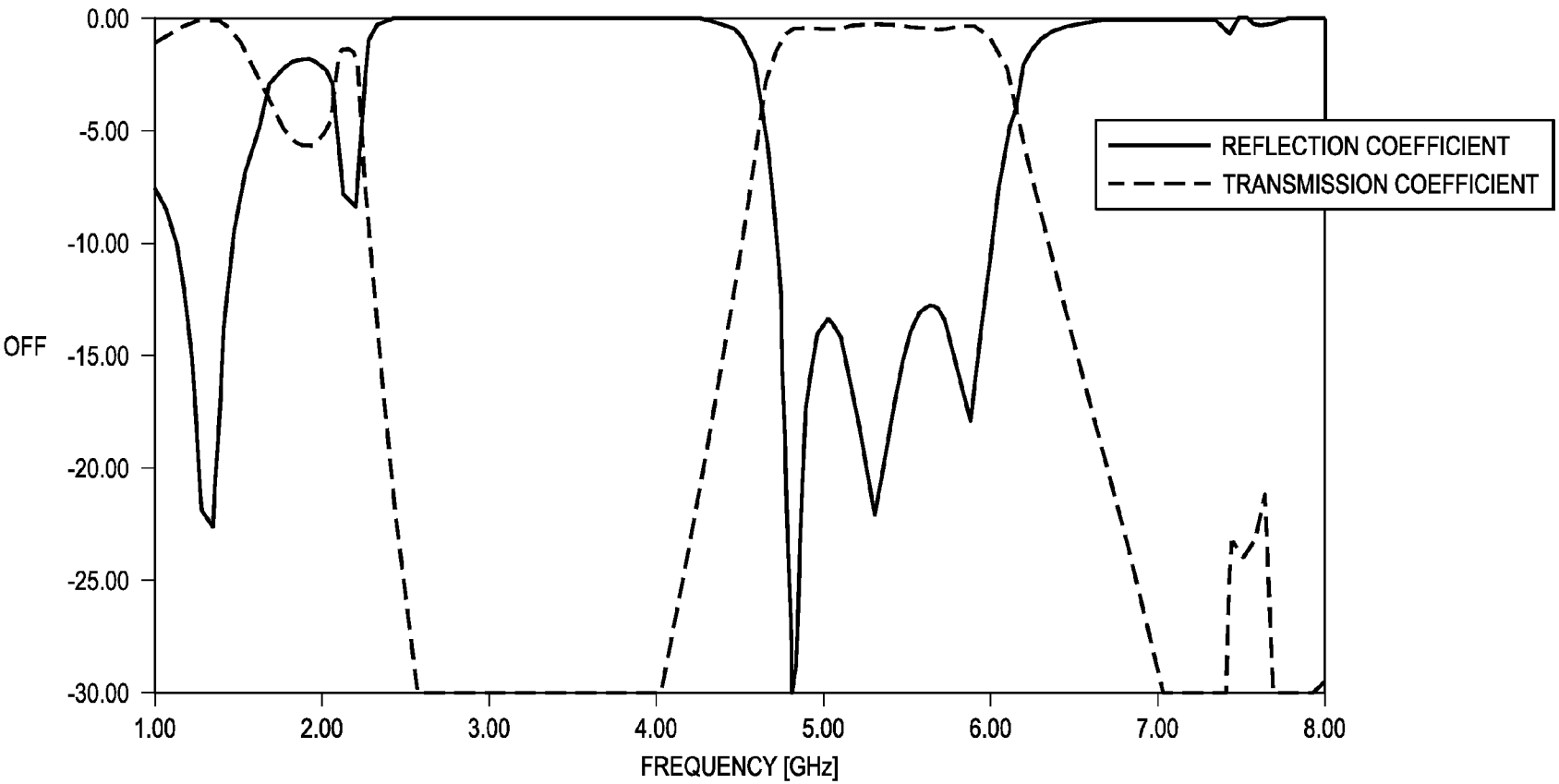
FIG. 11 is a graph of a frequency spectrum for the second design of the test waveguide structure of FIG. 7 in OFF state.

FIG. 10 shows a frequency spectrum for another example design of test waveguide structure in ON state (PIN diodes 207 are switched ON), and FIG. 11 is the frequency spectrum in the OFF state (PIN diodes 207 are switched OFF). The design corresponds includes the following dimensions: H=10 mm, Dw=3.2 mm, L=9.2 mm, and Dclear=8 mm. The resonator is turned ON and OFF by DC control of the PIN diode 207. The values of the transmission coefficient (dashed line curve) and the reflection coefficient (solid line curve) are shown in dB across a frequency range from 1 to 8 GHz. The curves in FIGS. 10 and 11 show that the resonator structures can be used for passing radiation when the PIN diodes 207 are OFF, in the band from 5 to 6 GHz. The results in FIGS. 8 to 11 show that changing the length of micro-strips affects the switching effect of the PIN diodes 207, and hence the operation of the waveguide structure and thus the beamsteering of the RF signal.

Figure 12:
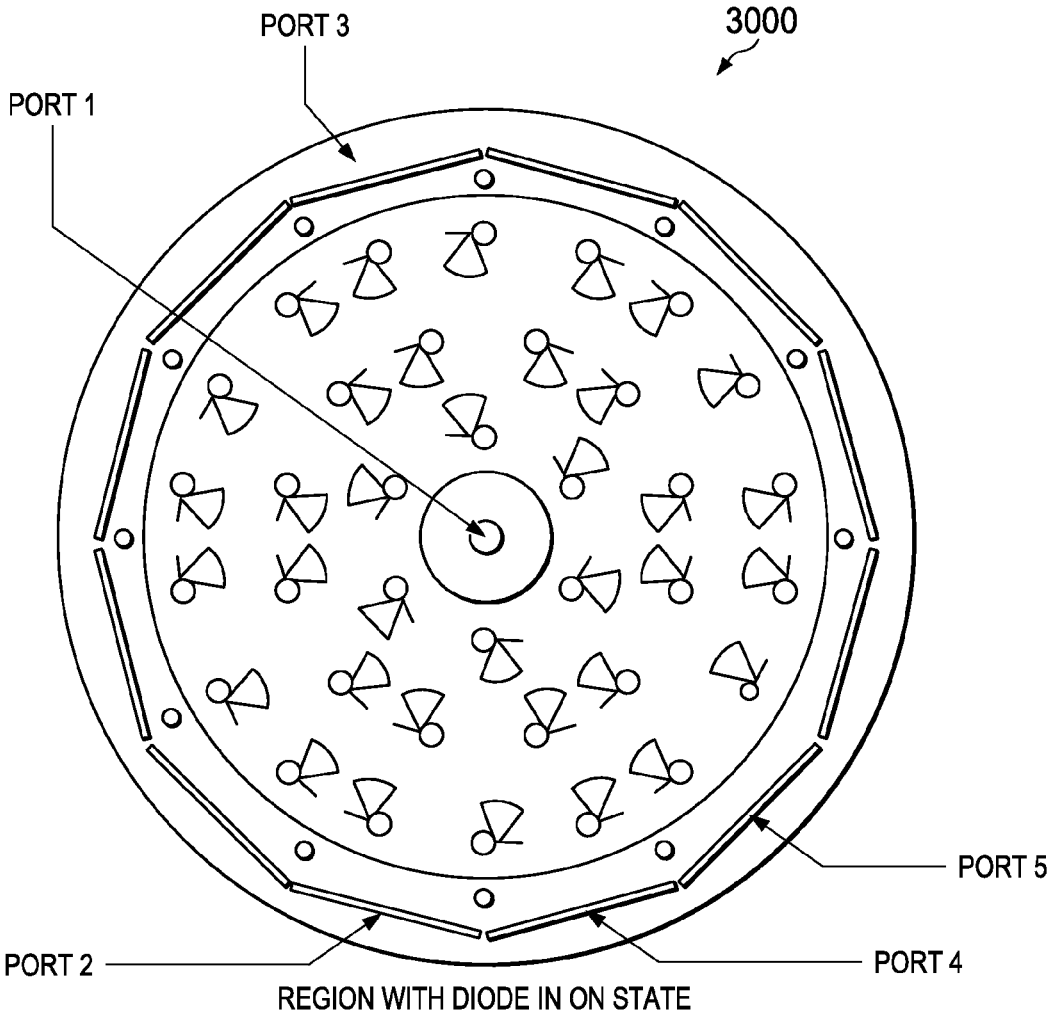
FIG. 12 is a top view of a power divider configuration of a radial waveguide structure of the antenna, according to an embodiment of the disclosure.
Figure 13:
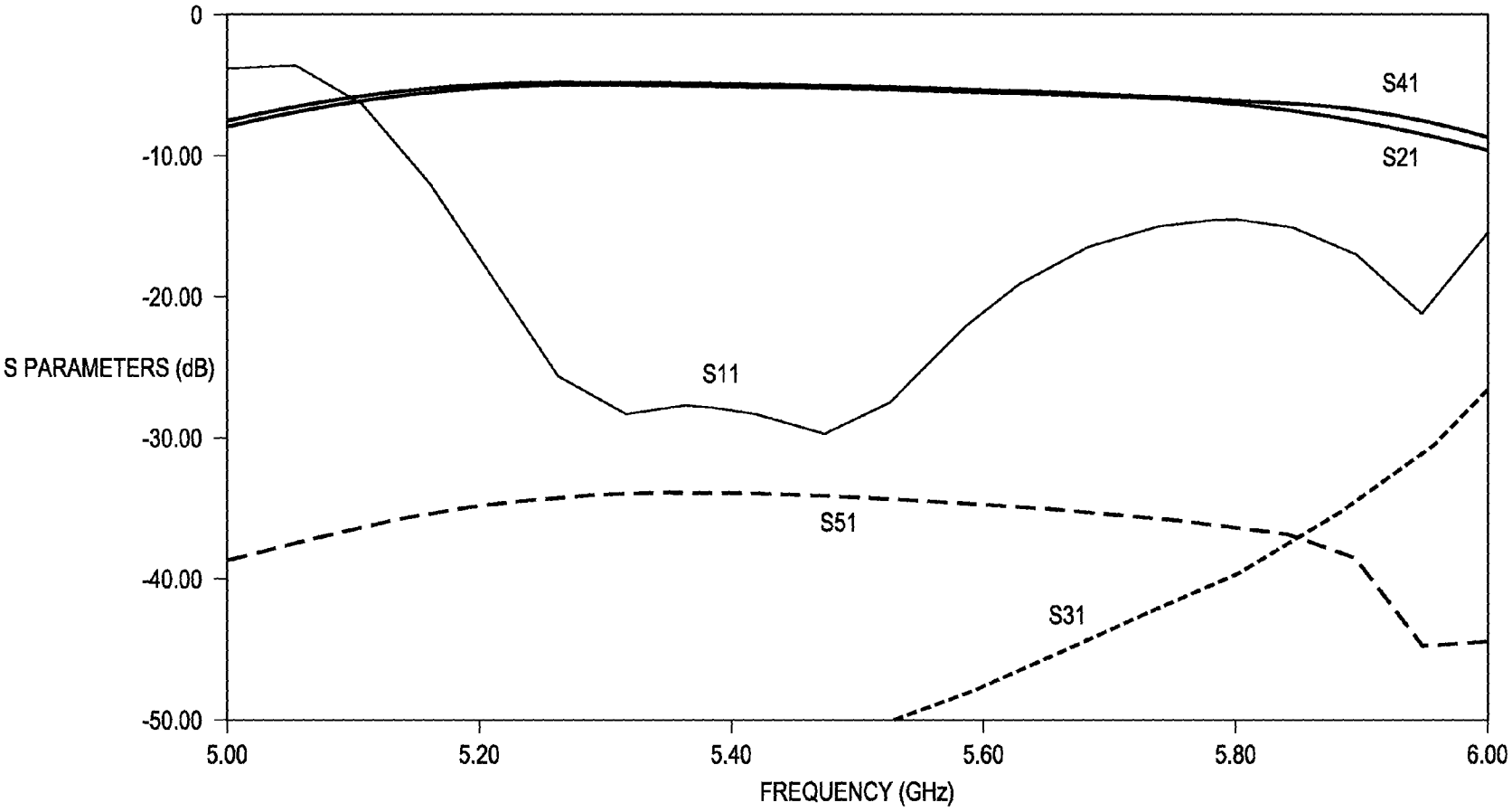
FIG. 13 is a graph of the frequency spectrum of different ports in the power divider configuration of FIG. 12.

FIG. 12 shows an example of a power divider configuration 3000 of the antenna. The resonator structures are grouped into different groups, each corresponding to a port of the radial waveguide structure 205/206. The radial waveguide structure 205/206 has a diameter of about 164 mm, and the height of separation between the plates of the radial waveguide structure 205/206 is equal to about 10 mm. The radial waveguide structure 205/206 includes 36 resonator structures with 36 corresponding diodes, and a total of 12 ports, each port being controlled by several DC switches. Five ports are shown for illustration. Only the resonators corresponding to ports 2 and 4 are turned ON (e.g., the diodes are turned ON). Other configurations can include less or more ports or different groupings of the resonators, e.g., to achieve a desired power divider transmission spectrum. FIG. 13 shows the frequency spectrum (in dB) for the coefficient S11 (reflection coefficient at port 1), S21 (transmission coefficient from port 1 to port 2), S31 (transmission coefficient from port 1 to port 3), S41 (transmission coefficient from port 1 to port 4), and S51 (transmission coefficient from port 1 to port 5), according to the configuration of FIG. 12. In the range from 5 to 6 GHz and excitation at port 1 (corresponding to the line feed in the center of the radial waveguide structure), ports 2 and 4 show relatively high transmission, while port 1 shows good (low) reflection coefficient. The remaining ports 3 and 5 (with diodes turned OFF) show relatively low transmission. Thus, this power divider configuration allows beamsteering of the RF radiation from the line feed in the direction of the ports 2 and 4.

Figure 14:
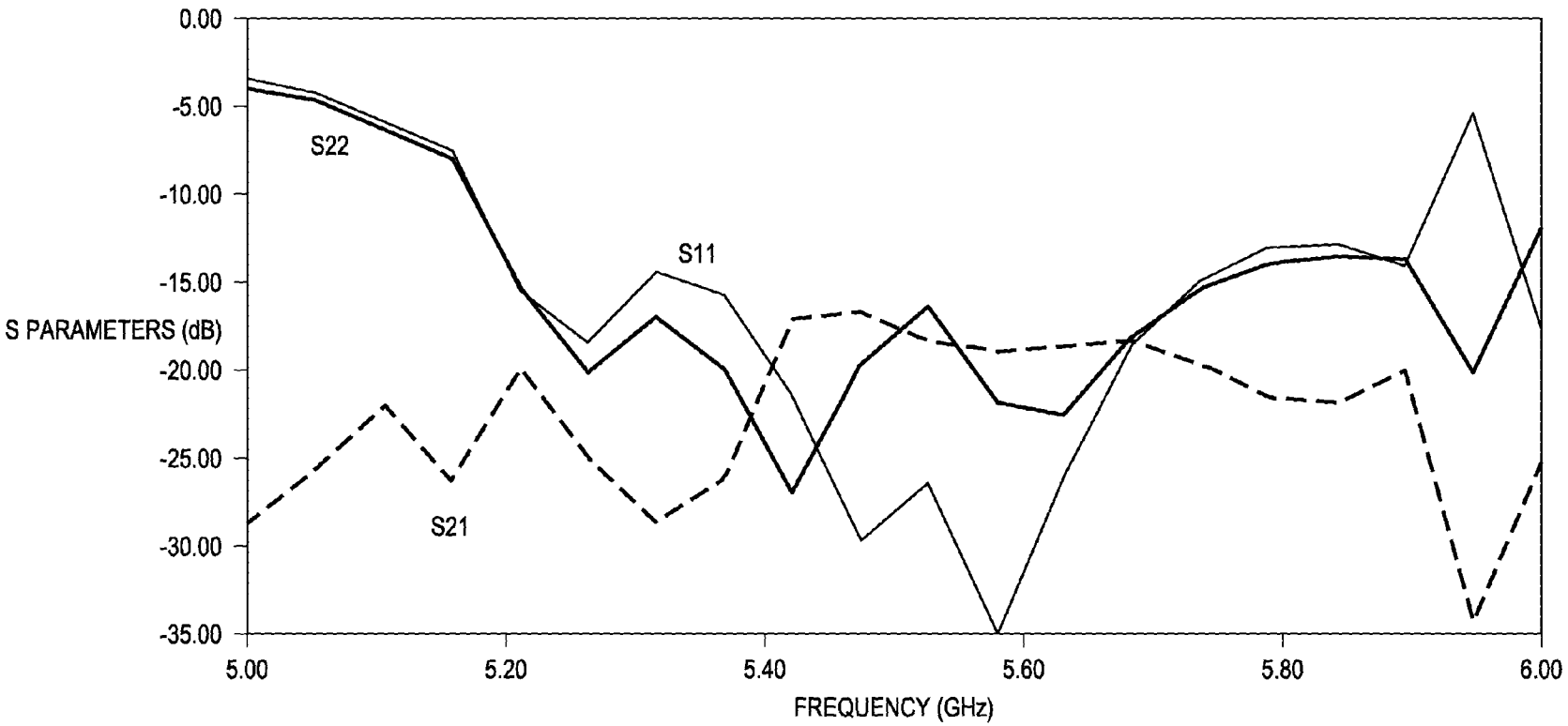
FIG. 14 is graph of a frequency spectrum for a configuration of the dual port waveguide antenna of FIG. 2, according to an embodiment of the disclosure.
Figure 15:
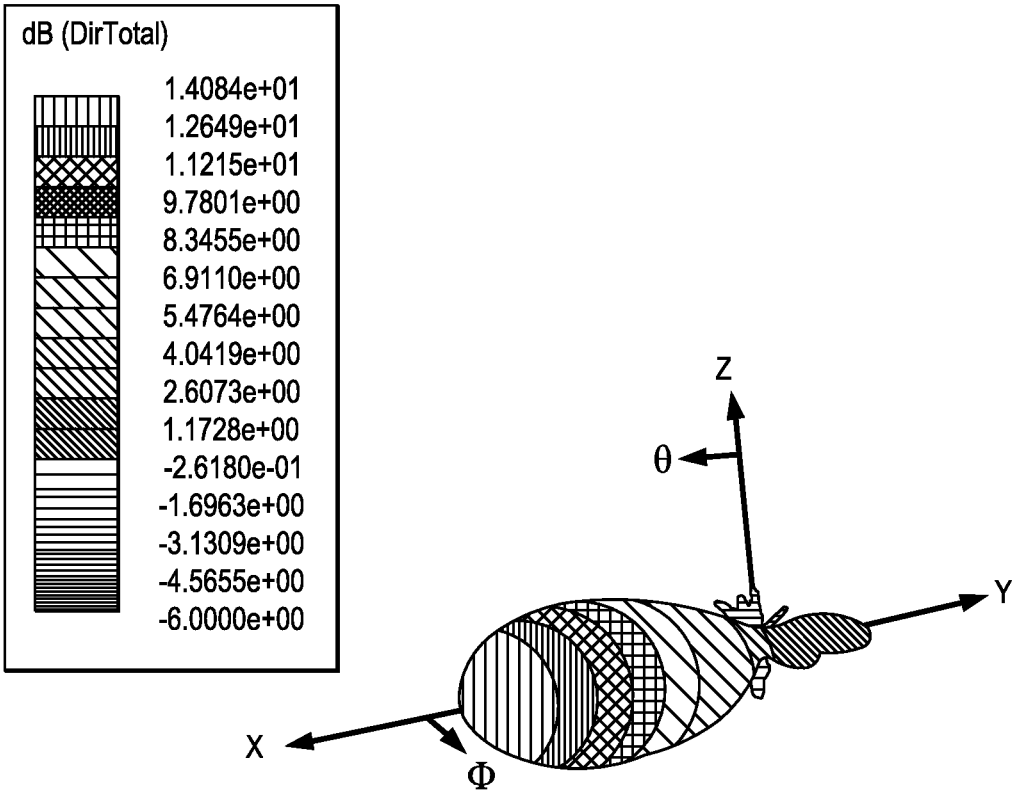
FIG. 15 is an illustration of the radiation pattern of the dual port waveguide antenna of FIG. 2.
Figure 16:
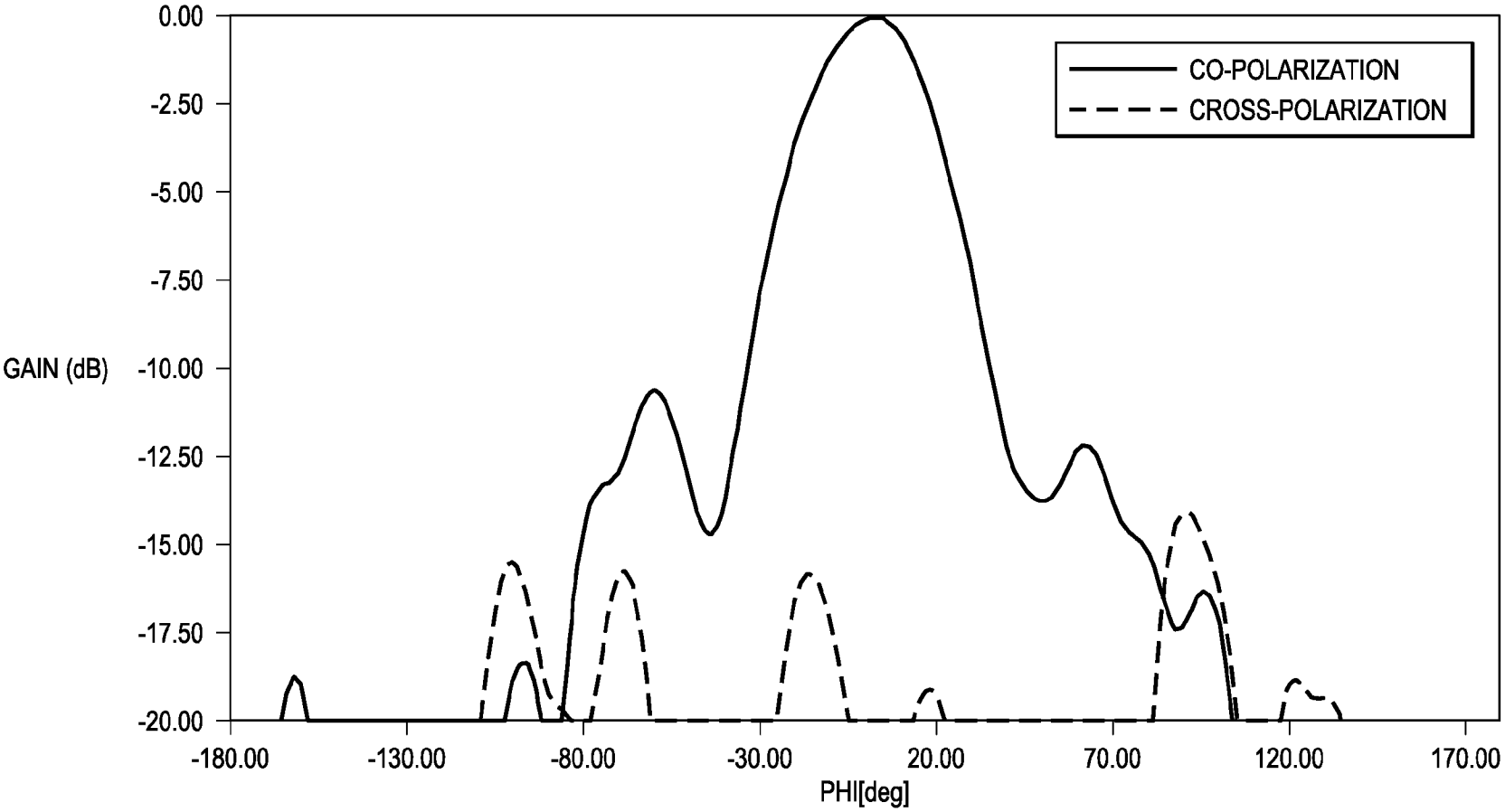
FIG. 16 is an illustration of co-polarization and cross-polarization gain of the dual port waveguide antenna of FIG. 2.
Figure 17:
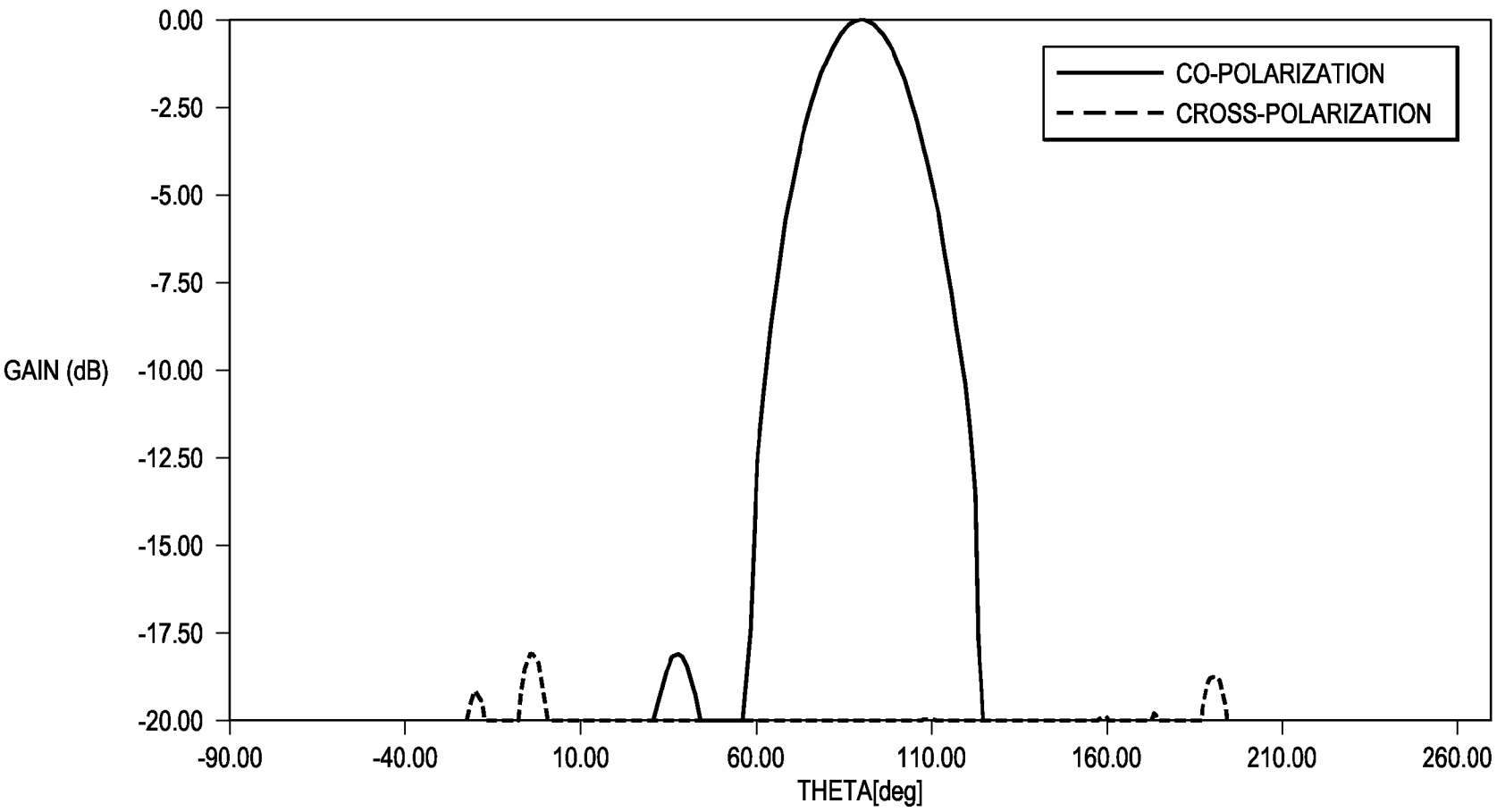
FIG. 17 is an illustration of co-polarization and cross-polarization gain of the dual port waveguide antenna of FIG. 2.

FIG. 14 shows a frequency spectrum for an exemplary configuration of the dual port waveguide antenna. Specifically, the power divider is configured and controlled (by turning ON/OFF selected diodes) similarly at the two radial waveguide structures 205/206 to achieve a desired radiation pattern. The figure shows good impedance matching: the reflection coefficient S11 at port 1 corresponding to the line fine of one waveguide and the reflection coefficient S22 of port 2 corresponding to the line feed of the other waveguide are low. The figure shows also low coupling between ports 1 and 2: transmission coefficient from port 2 to port 1 or vice versa is low. Ideally, the coupling of the waveguides at a desired band range should be relatively low in the range from 5 to 6 GHz. FIG. 15 shows the corresponding radiation pattern (in 3D space) of the configuration of FIG. 14. FIG. 16 shows the normalized gain in dB of co-polarization (solid line) and cross-polarization (dashed line) of the two waveguides of FIG. 15 on a first plane (Y-Z plane), and FIG. 17 shows the normalized gain of the co-polarization and cross-polarization on a second plane (X-Y plane). FIGS. 16 and 17 show relatively high transmission (polarization) at the corresponding planes and relatively low cross polarization due to coupling between the two waveguides.

Figure 18:
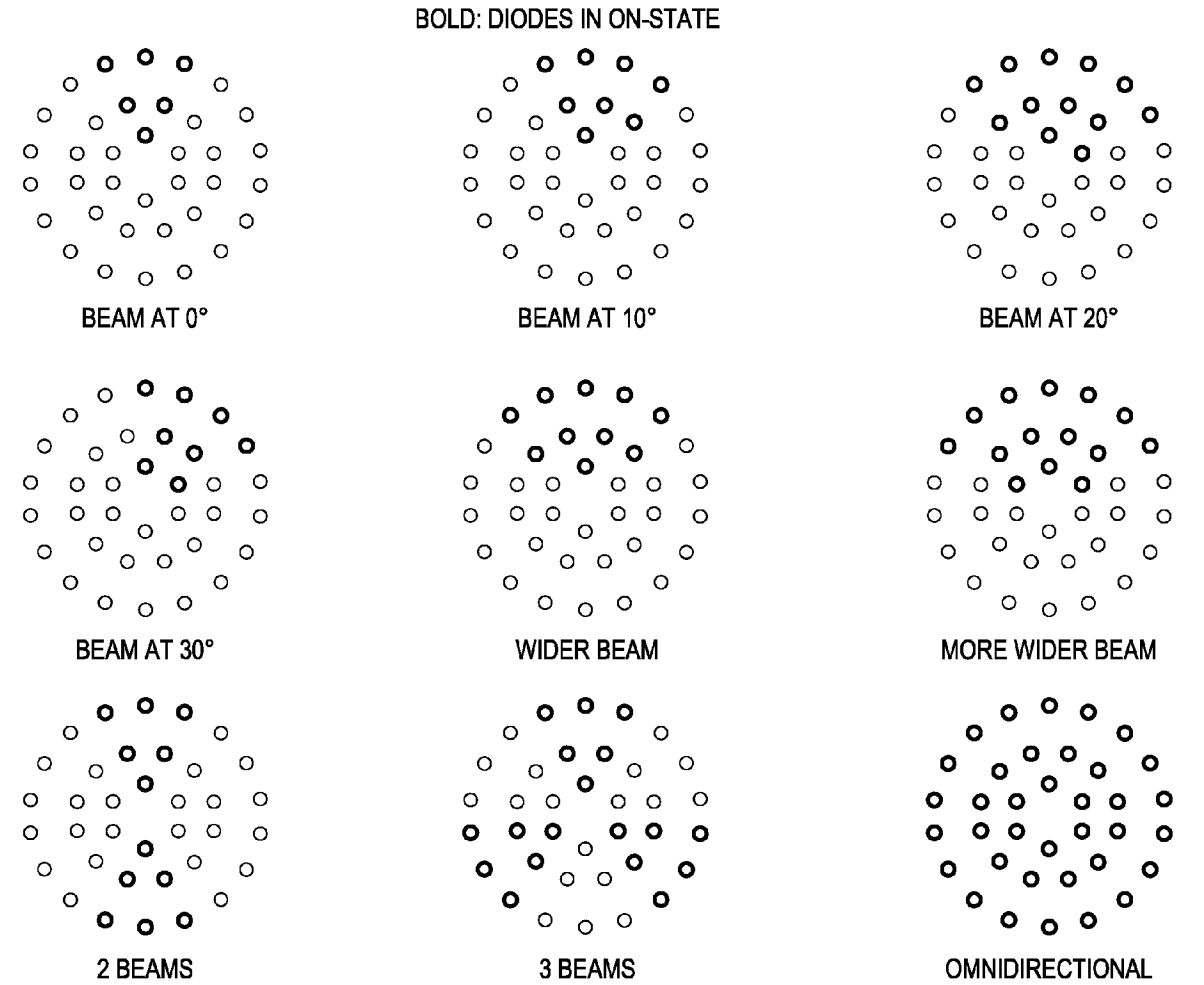
FIG. 18 is an illustration of a plurality of examples for achieving different beam radiation patterns and orientations by controlling a power divider of the antenna.

FIG. 18 illustrates various beam radiation patterns and orientations achievable by controlling a power divider of the antenna, as described above. The patterns include various orientation of the beam (at different angles, e.g., 0, 10°, 20°, 30°), various beam shapes (e.g., wider beam, more wider beam), and various numbers of simulated radiated beams (e.g., in one or more directions). The various beam formations above can be achieved using the same waveguide structures (the same dual port antenna) by tuning ON/OFF different groups of diodes (for different resonators).

Figure 19:
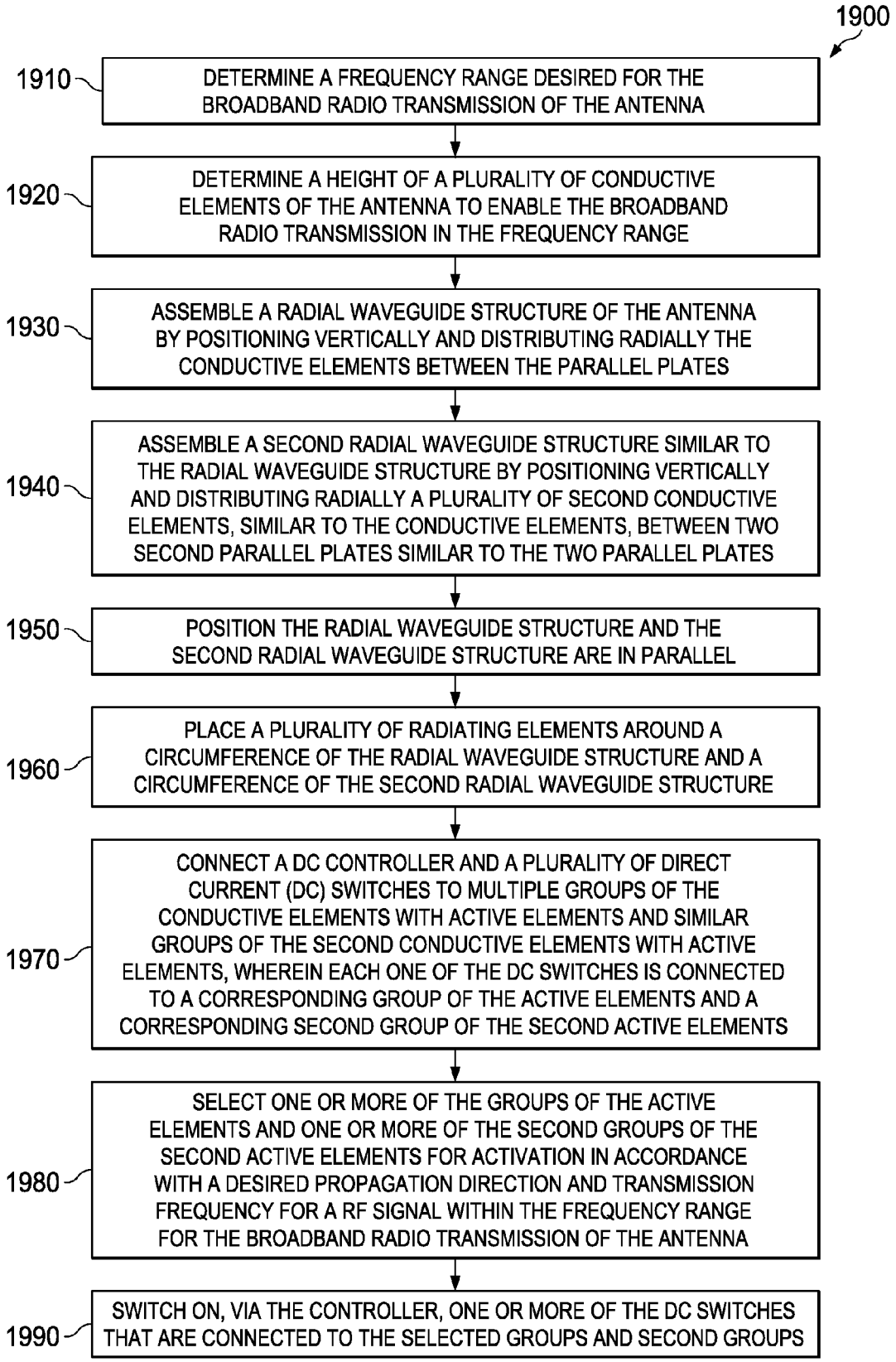
FIG. 19 illustrates a flowchart of an embodiment method for making and using the dual port waveguide antenna.

FIG. 19 shows an embodiment method 1900 for making and using the agile antenna as described above. At step 1910, a frequency range desired for the broadband radio transmission of the antenna is determined. At step 1920, a height of a plurality of cylindrical conductive elements of the antenna is determined to enable the broadband radio transmission in the frequency range. At step 1930, a radial waveguide structure of the antenna is assembled by positioning vertically and distributing radially the cylindrical conductive elements between the parallel plates. At step 1940, a second radial waveguide structure similar to the radial waveguide structure is assembled by positioning vertically and distributing radially a plurality of second cylindrical conductive elements, similar to the cylindrical conductive elements, between two second parallel plates similar to the two parallel plates. At step 1950, the radial waveguide structure and the second radial waveguide structure are positioned in parallel. At step 1960, a plurality of radiating elements are placed around a circumference of the radial waveguide structure and a circumference of the second radial waveguide structure. At step 1970, a DC controller and a plurality of direct current (DC) switches are connected to multiple groups of the cylindrical conductive elements with tunable elements and similar groups of the second cylindrical conductive elements with second tunable elements. Each one of the DC switches is connected to a corresponding group of the tunable elements and a corresponding second group of the second tunable elements. At step 1980, one or more of the groups of the tunable elements and one or more of the second groups of the second tunable elements are selected for activation in accordance with a desired propagation direction and transmission frequency for a RF signal within the frequency range for the broadband radio transmission of the antenna. At step 1990, one or more of the DC switches that are connected to the selected groups and second groups are switched ON, via the controller.

Figure 20:
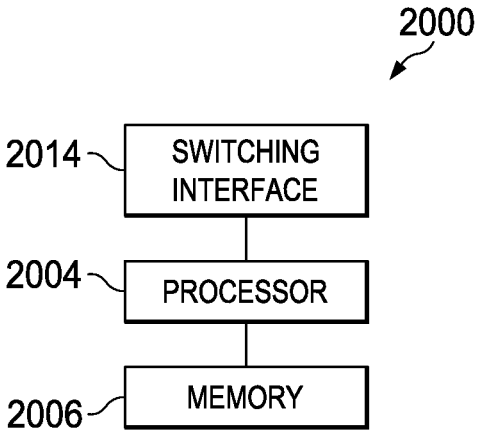
FIG. 20 illustrates a block diagram of an embodiment communications device.

FIG. 20 illustrates a block diagram of an embodiment of a communications device 2000 including a processor 2004, a memory 2006, and a switching interface 2014, which may (or may not) be arranged as shown in FIG. 20. The processor 2004 may be any component capable of performing computations and/or other processing related tasks, and may be equivalent to the microcontroller 250 (discussed above). The memory 2006 may be any component capable of storing programming and/or instructions for the processor 2004. The switching interface 2014 may be any component or collection of components that allows the processor 2004 to manipulate or otherwise control a series of DC switches for the purpose of effectuating beamsteering on an agile antenna.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

What is claimed is:

1. A radial waveguide structure in an antenna comprising:

a first radial plate;

a second radial plate substantially in parallel with the first radial plate;

a plurality of conductive elements positioned vertically and distributed radially between the first radial plate and the second radial plate, wherein the conductive elements are connected to micro-strips and tunable elements;

a plurality of direct current (DC) switches coupled to the tunable elements; and a plurality of quarter radio frequency (RF) chokes, wherein the RF chokes are connected to the conductive elements via the micro-strips and the tunable elements, wherein the first radial plate and the second radial plate are separated by a height determined according to a desired transmission frequency range for RF signals, a length of the micro-strips, a diameter of the conductive elements, and a diameter of a clearance space around each one of the conductive elements.

2. The radial waveguide structure of claim 1, wherein the height is equal to about a quarter of a wavelength, the wavelength corresponding to a transmission frequency for the RF signals.

3. The radial waveguide structure of claim 1, wherein the height of separation of the first radial plate and the second radial plate, the length of the micro-strips, the diameter of the conductive elements, and the diameter of the clearance space have dimensions determining a broadband transmission of the antenna, the broadband transmission overlapping with a frequency range from about 5 Gigahertz to about 6 Gigahertz.

4. The radial waveguide structure of claim 1, wherein the height of separation of the first radial plate and the second radial plate, the length of the micro-strips, the diameter of the conductive elements, and the diameter of the clearance space have dimensions determining a broadband transmission of the antenna, the broadband transmission overlapping with a frequency range from about 1 Gigahertz to about 8 Gigahertz.

5. The radial waveguide structure of claim 1, wherein the micro-strips connected to the conductive elements have variable lengths, and wherein the variable lengths of the micro-strips provide transmission over a wider range of frequencies in comparison to one length of the micro-strips.

6. The radial waveguide structure of claim 1, wherein the tunable elements are diodes positioned between the micro-strips and the RF chokes, wherein the DC switches are coupled to a controller, the controller and the DC switches being configured to activate and deactivate the diodes, and wherein activation or deactivation of the DC switches directs propagation of the RF signals.

7. The radial waveguide structure of the claim 6, wherein each one of the DC switches is connected to a corresponding group of the diodes and activates or deactivates all the diodes of the corresponding group.

8. The radial waveguide structure of claim 7, wherein all activated or deactivated diodes of the corresponding group behave as a power divider determining a transmission direction and a transmission coefficient for the RF signals.

9. The radial waveguide structure of claim 6, wherein the length of the micro-strips determines transmission of the RF signals in response to one of activating and deactivating the diodes.

10. The radial waveguide structure of claim 1, wherein the tunable elements are micro-electromechanical systems (MEMS).

11. An antenna device comprising:

a first radial waveguide structure comprising two first parallel radial plates and a plurality of first conductive elements connected to first tunable elements and positioned vertically between the two first parallel radial plates, wherein the two first parallel radial plates are separated by a height determined according to desired transmission frequency range for radio frequency (RF) signals, a diameter of the first conductive elements, and a clearance space around each one of the first conductive elements;

a second radial waveguide structure comprising two second parallel radial plates and a plurality of second conductive elements connected to second tunable elements, wherein the second conductive elements have a same clearance space as the first conductive elements and are positioned vertically between the two second parallel radial plates, and wherein the two second parallel radial plates are separated by a same height of separation of the first two parallel radial plates;

a plurality of direct current (DC) switches connected to the first tunable elements and the second tunable elements; and a plurality of radiating elements positioned between the first radial waveguide structure and the second radial waveguide structure, and distributed radially around a circumference of the first radial waveguide structure and a circumference of the second radial waveguide structure, wherein the first radial waveguide structure and the second radial waveguide structure are substantially in parallel.

12. The antenna device of claim 11 further comprising:

a first line feed connected substantially to a center of a surface of the first radial waveguide structure and to a RF signal source;

a second line feed connected to substantially a center of a surface of the second radial waveguide structure and to the RF signal source;

and a controller for the DC switches, the controller enabling activating and deactivating the first tunable elements and the second tunable elements by switching the DC switches ON and OFF.

13. The antenna device of claim 12, wherein each one of the first and second conductive elements is connected to a micro-strip and a diode, and wherein the antenna device further comprises a plurality of RF chokes, each one of the RF chokes being connected to one of the diodes.

14. The antenna device of claim 13, wherein the same height of separation of the two first parallel radial plates and of the two second parallel radial plates is determined in accordance with a length of the micro-strip, the diameter of the first and second conductive elements, and the clearance space around each one of the first and second conductive elements.

15. The antenna device of claim 14, wherein the height, the length of the micro-strip, the diameter of the first and second conductive elements, and the clearance space determine a broadband transmission of the antenna device, the broadband transmission overlapping with a frequency range from about 5 Gigahertz to about 6 Gigahertz.

16. The antenna device of claim 14, wherein the height, the length of the micro-strip, the diameter of the first and second conductive elements, and the clearance space determine a broadband transmission of the antenna device, the broadband transmission overlapping with a frequency range from about 1 Gigahertz to about 8 Gigahertz.

17. The antenna device of claim 11, wherein the DC switches are connected to corresponding groups of the first tunable elements and to corresponding groups of the second tunable elements.

18. The antenna device of claim 17, wherein the first radial waveguide structure and the second radial waveguide structure have a diameter greater than 100 millimeters (mm), the height of separation between each one of the two first parallel radial plates and the two second parallel radial plates is equal to 10 mm, a total number of each one of the first tunable elements and the second tunable elements is 36 tunable elements, and a total number of each one of the corresponding groups of the first tunable elements and the corresponding groups of the second tunable elements is 18 groups.

19. A method for manufacturing an antenna with a broadband radio transmission, the method comprising:

determining a frequency range desired for the broadband radio transmission of the antenna;

determining a height of a plurality of first conductive elements of the antenna, wherein the height enables the broadband radio transmission in the frequency range;

determining, in accordance with the height and the frequency range, a diameter of two first parallel plates of the antenna;

assembling a first radial waveguide structure of the antenna by positioning vertically and distributing radially the first conductive elements between the first parallel plates, and coupling the first conductive elements to respective first tunable elements;

assembling a second radial waveguide structure by positioning vertically and distributing radially a plurality of second conductive elements, between two second parallel plates, and coupling the second conductive elements to respective second tunable elements;

positioning the first radial waveguide structure and the second radial waveguide structure substantially in parallel;

connecting a plurality of direct current (DC) switches to respective groups of the first tunable elements via the first conductive elements and to respective groups of the second tunable elements via the second conductive elements; and placing a plurality of radiating elements around a circumference of the first radial waveguide structure and a circumference of the second radial waveguide structure.

20. The method of claim 19 further comprising:

determining, in accordance with the height and the frequency range, a diameter of the first and second conductive elements;

determining, in accordance with the height and the frequency range, a length of a micro-strip connecting a corresponding diode to each one of the first conductive elements and the second conductive elements; and determining, in accordance with the height and the frequency range, a clearance space diameter around each one of the first conductive elements and the second conductive elements.

21. The method of claim 20, wherein the method further comprises:

connecting the DC switches to a controller;

selecting the first and second tunable elements for activation in accordance with a desired propagation direction and transmission frequency for a RF signal within the frequency range for the broadband radio transmission of the antenna; and switching ON, via the controller, one or more of the DC switches that are connected to the selected first and second tunable elements.

* * * * *